US010920790B2

(12) United States Patent
Chen

(10) Patent No.: US 10,920,790 B2
(45) Date of Patent: Feb. 16, 2021

(54) FAN

(71) Applicant: DELTA ELECTRONICS, INC., Taoyuan (TW)

(72) Inventor: Cheng-Wei Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 70 days.

(21) Appl. No.: 16/229,440

(22) Filed: Dec. 21, 2018

(65) Prior Publication Data

US 2019/0195242 A1 Jun. 27, 2019

Related U.S. Application Data

(60) Provisional application No. 62/609,996, filed on Dec. 22, 2017.

(30) Foreign Application Priority Data

Dec. 5, 2018 (CN) ..... 201811478210.6

(51) Int. Cl.

| | |
|---|---|
| ***F04D 29/62*** | (2006.01) |
| ***F04D 29/28*** | (2006.01) |
| ***F04D 17/08*** | (2006.01) |
| ***F04D 25/06*** | (2006.01) |
| ***F04D 17/16*** | (2006.01) |

(52) U.S. Cl.

CPC ..... *F04D 29/626* (2013.01); *F04D 17/08* (2013.01); *F04D 17/161* (2013.01); *F04D 25/0613* (2013.01); *F04D 29/281* (2013.01)

(58) Field of Classification Search

None

See application file for complete search history.

(56) References Cited

U.S. PATENT DOCUMENTS

| | | | | |
|---|---|---|---|---|
| 5,427,503 | A | 6/1995 | Haraga et al. | |
| 2001/0019693 | A1* | 9/2001 | Dial | F01D 1/36 415/83 |
| 2003/0002976 | A1* | 1/2003 | Dial | F01D 1/36 415/90 |
| 2005/0019154 | A1* | 1/2005 | Dial | F01D 1/36 415/90 |
| 2006/0253194 | A1* | 11/2006 | Dial | F04D 5/001 623/3.13 |
| 2017/0205108 | A1* | 7/2017 | Petrovic | F01D 1/36 |
| 2017/0300094 | A1* | 10/2017 | Delano | F04D 29/584 |

(Continued)

FOREIGN PATENT DOCUMENTS

JP H04321794 A 11/1992

*Primary Examiner* — Michael Lebentritt

(74) *Attorney, Agent, or Firm* — Muncy, Geissler, Olds & Lowe, P.C.

(57) ABSTRACT

A fan includes a frame, an impeller, and a motor. The impeller is disposed in the frame and includes a hub, a plurality of annular blades, and a plurality of spacers. The annular blades are stacked along an axial direction of the hub and disposed around the outer periphery of the hub. The extension directions of the annular blades are perpendicular to the axial direction of the hub. Each of the spacers is disposed between the two adjacent annular blades. The motor is disposed in the frame and drives the impeller to rotate to induce an airflow. The thickness of each annular blade is smaller than or equals to 0.2 mm.

19 Claims, 11 Drawing Sheets

(56) References Cited

U.S. PATENT DOCUMENTS

| | | | | |
|---|---|---|---|---|
| 2017/0356463 | A1* | 12/2017 | Hino | F04B 35/04 |
| 2017/0356464 | A1* | 12/2017 | Hino | F04B 35/04 |
| 2017/0356465 | A1* | 12/2017 | Hino | F04B 35/04 |
| 2017/0356466 | A1* | 12/2017 | Hino | F04D 17/161 |
| 2017/0356467 | A1* | 12/2017 | Hino | F04B 35/04 |
| 2018/0070472 | A1* | 3/2018 | Aiello | G06F 1/203 |
| 2019/0120238 | A1* | 4/2019 | Horng | F04D 19/002 |
| 2019/0305655 | A1* | 10/2019 | Brahmavar | H02K 1/148 |

* cited by examiner

FAN

CROSS REFERENCE TO RELATED APPLICATIONS

The non-provisional patent application claims priority to U.S. provisional patent application with Ser. No. 62/609,996 filed on Dec. 22, 2017. This and all other extrinsic materials discussed herein are incorporated by reference in their entirety.

This Non-provisional application claims priority under 35 U.S.C. § 119(a) on Patent Application No(s). 201811478210.6 filed in People's Republic of China on Dec. 5, 2018, the entire contents of which are hereby incorporated by reference.

BACKGROUND OF THE INVENTION

Field of Invention

This disclosure relates to a fan and, in particular, to a fan having annular blades.

Related Art

The current electronic devices will generate a lot of heat in operation as the performance of the electronic devices increases. If the heat cannot be dissipated immediately, the temperature inside the electronic device will increase, which may damage the internal components and decrease the performance and lifetime of the electronic device. A fan is a common heat dissipation device for the electronic devices. However, the conventional fan utilizes the blades to generate airflow by friction, so it may easily accompany the high-frequency noise, which can cause uncomfortable of the users.

Therefore, it is desired to provide a fan with lower high-frequency noise, thereby remaining the operation performance of the fan without causing uncomfortable of users.

SUMMARY OF THE INVENTION

An objective of this disclosure is to provide a fan with lower high-frequency noise and still remaining the operation performance of the fan.

This disclosure provides a fan, which comprises a frame, an impeller and a motor. The impeller is disposed in the frame and comprises a hub, a plurality of annular blades and a plurality of spacers. The annular blades are stacked along an axial direction of the hub and disposed around an outer periphery of the hub. The extension directions of the annular blades are perpendicular to the axial direction of the hub. Each of the spacers is disposed between the two adjacent annular blades. The motor is disposed in the frame and drives the impeller to rotate to induce an airflow. A thickness of each of the annular blades is smaller than or equals to 0.2 mm.

In one embodiment, each annular blade has an inner periphery, and a gap is provided between the inner periphery and the hub.

In one embodiment, a bottom portion of the hub has an extension portion extending outwardly and perpendicular to the axial direction, and the annular blades are stacked and disposed at one side of the extension portion.

In one embodiment, a bottom portion of the hub has an extension portion extending outwardly and perpendicular to the axial direction, and the annular blades are stacked and disposed at two sides of the extension portion.

In one embodiment, the hub further comprises a plurality of supporting columns, the supporting columns are disposed at the extension portion, each of the annular blades comprises a plurality of through holes, and the supporting columns pass through the through holes, respectively.

In one embodiment, the spacers are disposed around the supporting columns, respectively.

In one embodiment, the supporting columns are separately disposed on the extension portion with equivalent intervals.

In one embodiment, the supporting columns are separately disposed on the extension portion with inequivalent intervals.

In one embodiment, each annular blade further comprises a plurality of spokes and at least an inner ring, the inner ring is disposed on and connected to the outer periphery of the hub, and two ends of the spoke are connected to the inner periphery and the inner ring of the annular blade.

In one embodiment, the spacers are separately disposed on the inner rings of the annular blades, respectively.

In one embodiment, a bottom portion of the hub has a protrusion portion extending outwardly and perpendicular to the axial direction, and the annular blades are disposed on the protrusion portion of the hub by stacking the inner rings on the protrusion portion.

In one embodiment, a ratio of a thickness of each of the spacers to that of each of the annular blades is greater than or equal to 1.

In one embodiment, a ratio of an inner radius of the annular blades to an outer radius of the annular blades is greater than or equal to 0.5.

In one embodiment, the frame forms a guiding surface at an inner periphery of an air inlet of the fan.

As mentioned above, the fan of this disclosure comprises a plurality of annular blades stacked along an axial direction of the hub and disposed around an outer periphery of the hub, and the extension directions of the annular blades are perpendicular to the axial direction of the hub. Thus, the fan of this disclosure can induce the airflow by the shearing force. Compared with the convention fan that utilizes the friction of the blades to induce the airflow, the fan of this disclosure can decrease the high-frequency noise and increase the air pressure, thereby avoiding the uncomfortable of users and remaining the operation performance of the fan.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

This disclosure provides a fan that can decrease the high-frequency noise and increase the air pressure, thereby avoiding the uncomfortable of users and remaining the operation performance of the fan. The structure and features of the fan of this disclosure will be described in the following embodiments.

Figure 1A:
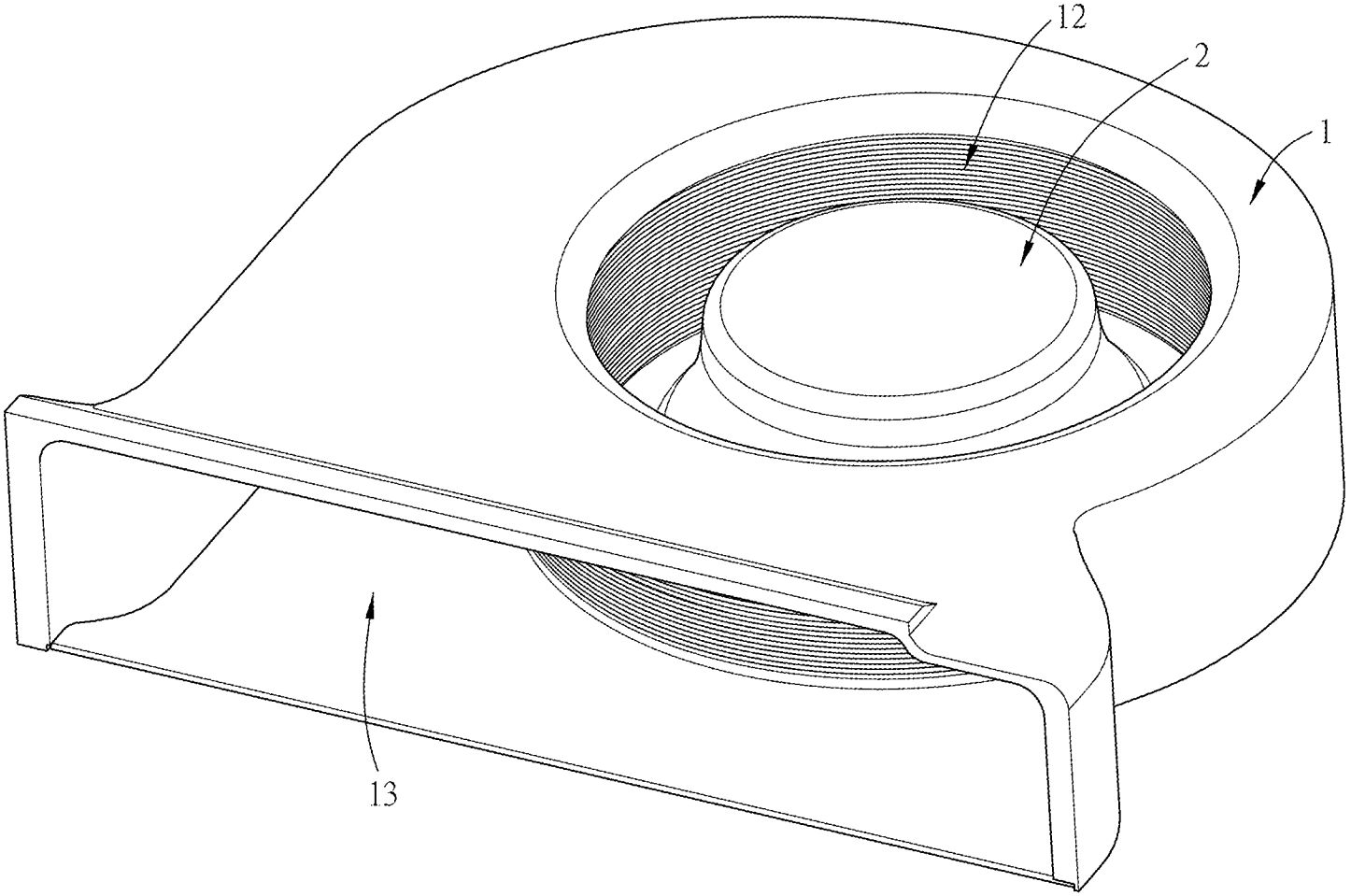
FIG. 1A is a schematic diagram showing a fan according to an embodiment of this disclosure.
Figure 1B:
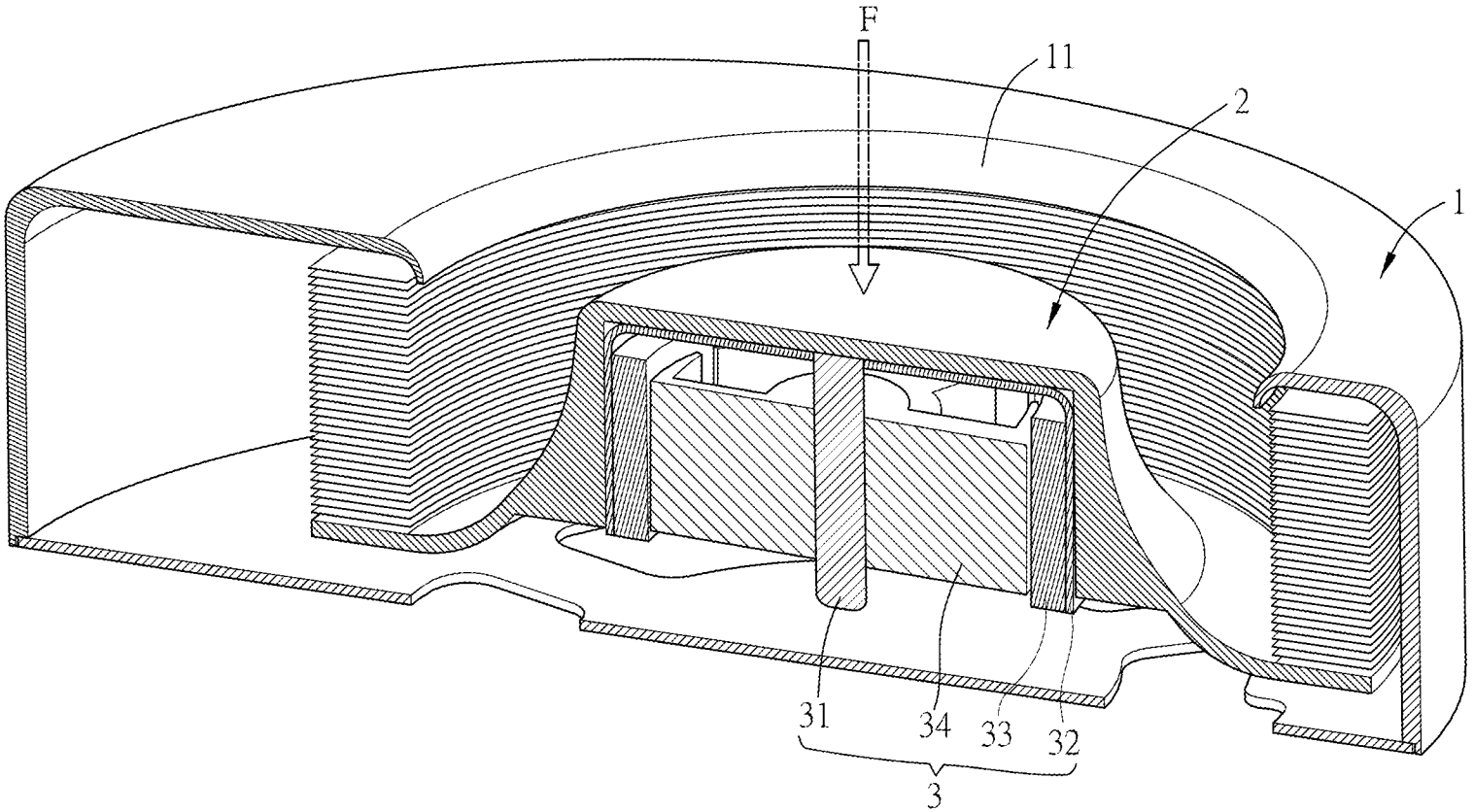
FIG. 1B is a sectional view of the fan of FIG. 1A.

FIG. 1A is a schematic diagram showing a fan according to an embodiment of this disclosure, and FIG. 1B is a sectional view of the fan of FIG. 1A. Referring to FIGS. 1A and 1B, the fan comprises a frame 1, an impeller 2, and a motor 3. The frame 1 comprises an air inlet 12 and an air outlet 13. The motor 3 is disposed in the frame 1 and drives the impeller 2 to rotate, thereby inducing an airflow from the air inlet 12 to the air outlet 13. In this embodiment, the motor 3 comprises a shaft 31, a magnetic shell 32, a magnetic element 33 and a stator structure 34. The magnetic shell 32 is disposed inside the impeller 2, and one end of the shaft 31 is connected to the magnetic shell 32. The magnetic element 33 is disposed on the inner periphery of the magnetic shell 32 and is located corresponding to the stator structure 34. The shaft 31 and the magnetic shell 32 can be combined by, for example, laser welding.

In this embodiment, a guiding curved surface 11 is formed on the inner periphery of the air inlet 12 of the frame 1 for guiding the airflow to enter the frame 1 along the air input direction F.

Figure 2A:
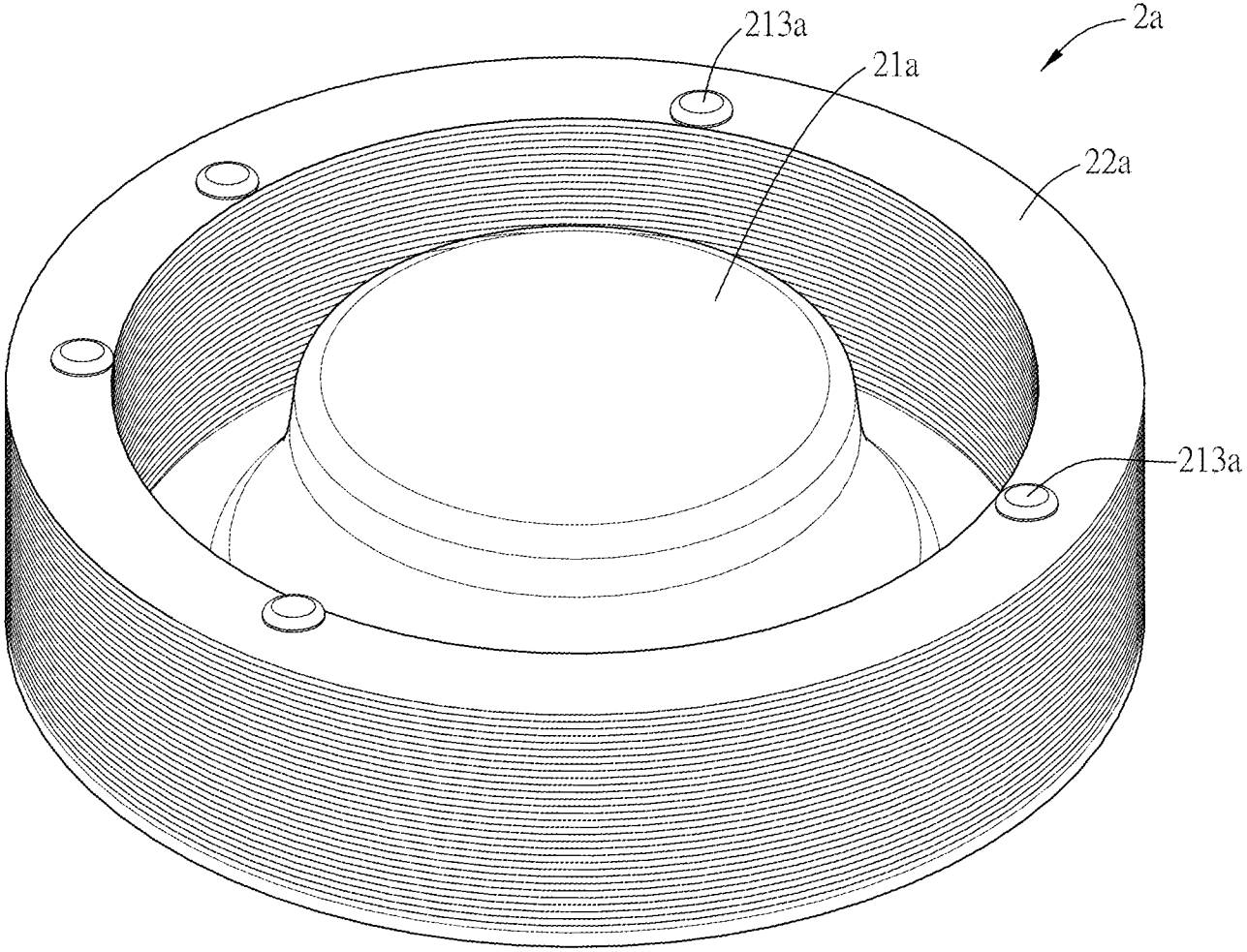
FIG. 2A is a schematic diagram showing the impeller of the fan according to a first embodiment of this disclosure.
Figure 2B:
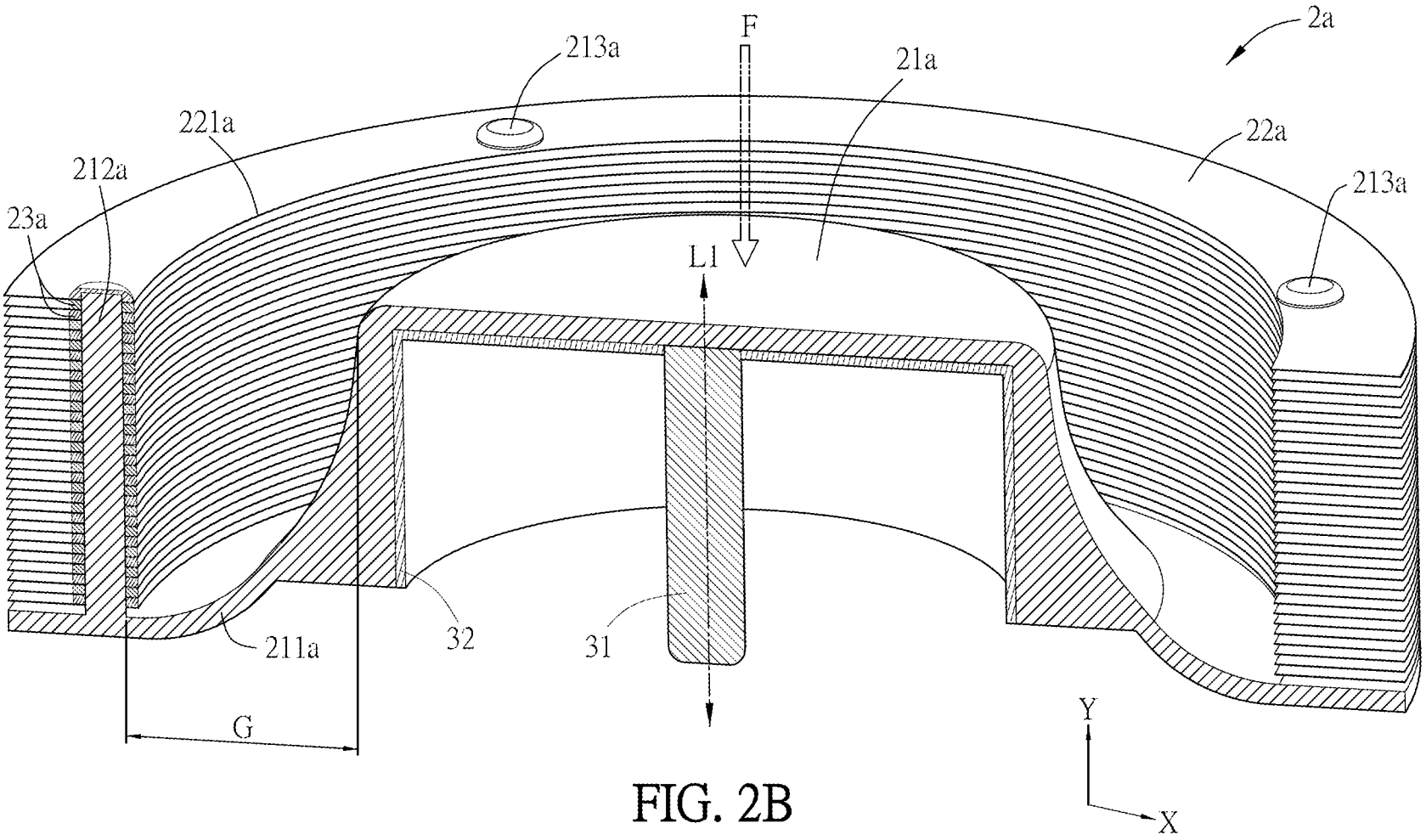
FIG. 2B is a sectional view of the impeller of FIG. 2A.

FIG. 2A is a schematic diagram showing the impeller of the fan according to a first embodiment of this disclosure, and FIG. 2B is a sectional view of the impeller of FIG. 2A. Referring to FIGS. 2A and 2B, the impeller 2*a* comprises a hub 21*a*, a plurality of annular blades 22*a*, and a plurality of spacers 23*a*. The annular blades 22*a* are stacked along an axial direction L1 of the hub 21*a* and disposed around an outer periphery of the hub 21*a*. The extension directions of the annular blades 22*a* are perpendicular to the axial direction L1 of the hub 21*a*. In more detailed, the axial direction L1 of the hub 21*a* is parallel to a Y-axis direction, and the extension directions of the annular blades 22*a* are parallel to an X-axis direction. The X-axis direction and the Y-axis direction are perpendicular to each other. Based on the configuration of the extension directions of the annular blades 22*a* and the axial direction L1 of the hub 21*a*, which are perpendicular to each other, the surface of the annular blades 22*a* can generate the shearing force caused by viscosity to induce the airflow, thereby decreasing the high-frequency noise generated by the fan.

In this embodiment, each of the spacers 23*a* is disposed between the two adjacent annular blades 22*a*, for separating the two adjacent annular blades 22*a*. The thickness of each of the annular blades 22*a* is preferably smaller than or equals to 0.2 mm. The ratio of a thickness of the spacer 23*a* to that of the annular blade 22*a* is preferably greater than or equal to 1. In other words, the thickness of the spacer 23*a* is equal to or larger than that of the annular blade 22*a*. In this embodiment, the height of the fan can be, for example but not limited to, less than or equal to 30 mm, and the number of the annular blades 22*a* can be, for example but not limited to, less than or equal to 62. In particular, the spacer 23*a* and the annular blade 22*a* can be integrally formed as a single piece. For example, the spacer 23*a* can be a protrusion on the annular blade 22*a* or a curved portion disposed at the tail of the annular blade 22*a*, and this disclosure is not limited. That is, each of the spacer 23*a* can be any structure that can form a gap between the two adjacent annular blades 22*a*.

Figure 2C:
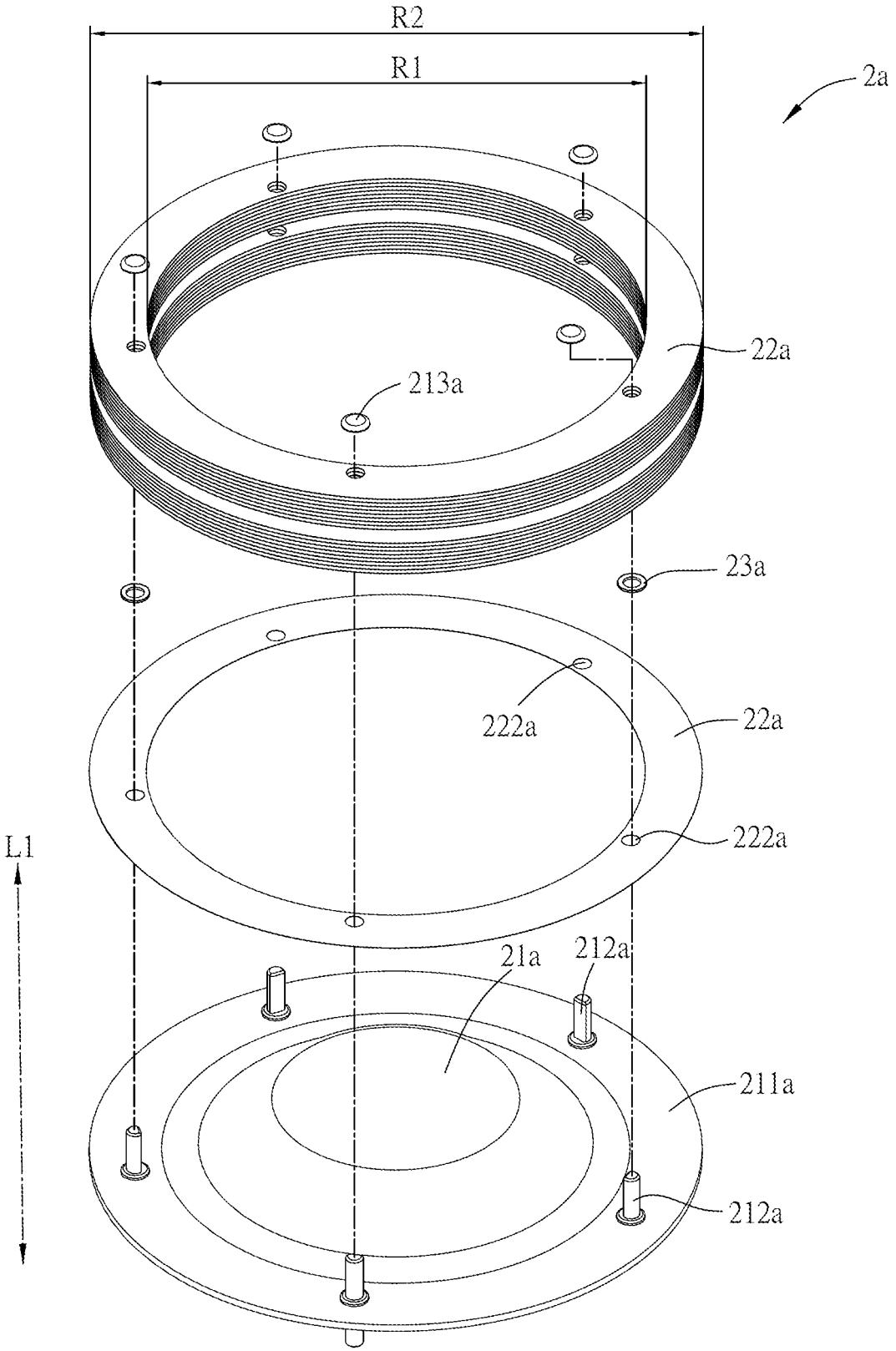
FIG. 2C is an exploded view of the impeller of FIG. 2A.

FIG. 2C is an exploded view of the impeller of FIG. 2A. Referring to FIGS. 2B and 2C, the annular blade 22*a* has an inner periphery 221*a*, and a gap G is provided between the inner periphery 221*a* and the hub 21*a*. Preferably, a ratio of an inner radius R1 of the annular blades 22*a* to an outer radius R2 of the annular blades 22*a* is greater than or equal to 0.5. Specifically, the gap G is configured for guiding the airflow, so that the airflow can pass through the gap G between the annular blades 22*a* and the hub 21*a*, the spaces between the annular blades 22*a* (formed by the spacers 23*a*), and the air outlet of the fan.

In this embodiment, the bottom portion of the hub 21*a* has an extension portion 211*a* extending outwardly and perpendicular to the axial direction L1, and the annular blades 22*a* are stacked and disposed at one side of the extension portion 211*a*. The hub 21*a* further comprises a plurality of supporting columns 212*a*, which are disposed at the extension portion 211*a*. Each annular blade 22*a* comprises a plurality of through holes 222*a*, and the supporting columns 212*a* pass through the through holes 222*a*, respectively. The spacers 23*a* are disposed around the supporting columns 212*a*. In particular, the supporting columns 212*a* can be disposed on the extension portion 211*a* of the hub 21*a* by, for example but not limited to, laser welding or injection molding.

As shown in FIG. 2C, the extension portion 211*a* of the hub 21*a* is configured with five supporting columns 212*a*, which are arranged with equivalent intervals. The annular blades 22*a* are stacked and disposed on the extension portion 211*a*. The supporting columns 212*a* pass through the corresponding through holes 222*a* of one annular blade 22*a*, and then the spaces 23*a* are disposed around the corresponding supporting columns 212*a*. Afterwards, another annular blade 22*a* is stacked on the previous annular blade 22*a*. After disposing the annular blades 22*a* and spacers 23*a* alternately, the annular blades 22*a* can be stacked and disposed at one side of the extension portion 211*a*. To be noted, although the figure shows five supporting columns 212*a* disposed with equivalent intervals, the number of the configured supporting columns 212*a* can be adjusted based on the requirement of the user. In addition, the supporting columns 212*a* can be separately disposed on the extension portion 211*a* with inequivalent intervals (e.g. the supporting columns 212*a* of FIG. 2B). This disclosure is not limited.

In this embodiment, the hub 21*a* can further comprise a plurality of fixing members 213*a* for firmly fixing the annular blades 22*a* on the supporting columns 212*a*. The fixing members 213*a* can be connected to the supporting columns 212*a* by welding or screwing. As shown in the figures, after disposing the annular blades 22*a* and the spacers 23*a* alternately, the fixing members 213*a* are provided to firmly fix the annular blades 22*a* and the supporting columns 212*a*. This configuration can prevent the noise caused by the unstable annular blades 22*a* while the impeller 2*a* is rotating. If the supporting columns 212*a* are made of plastic, it is also possible to melt the end portions of the supporting columns 212*a* for fixing and restricting the annular blades 22*a*. This approach can also achieve the same function of the fixing members 213*a*.

Figure 3A:
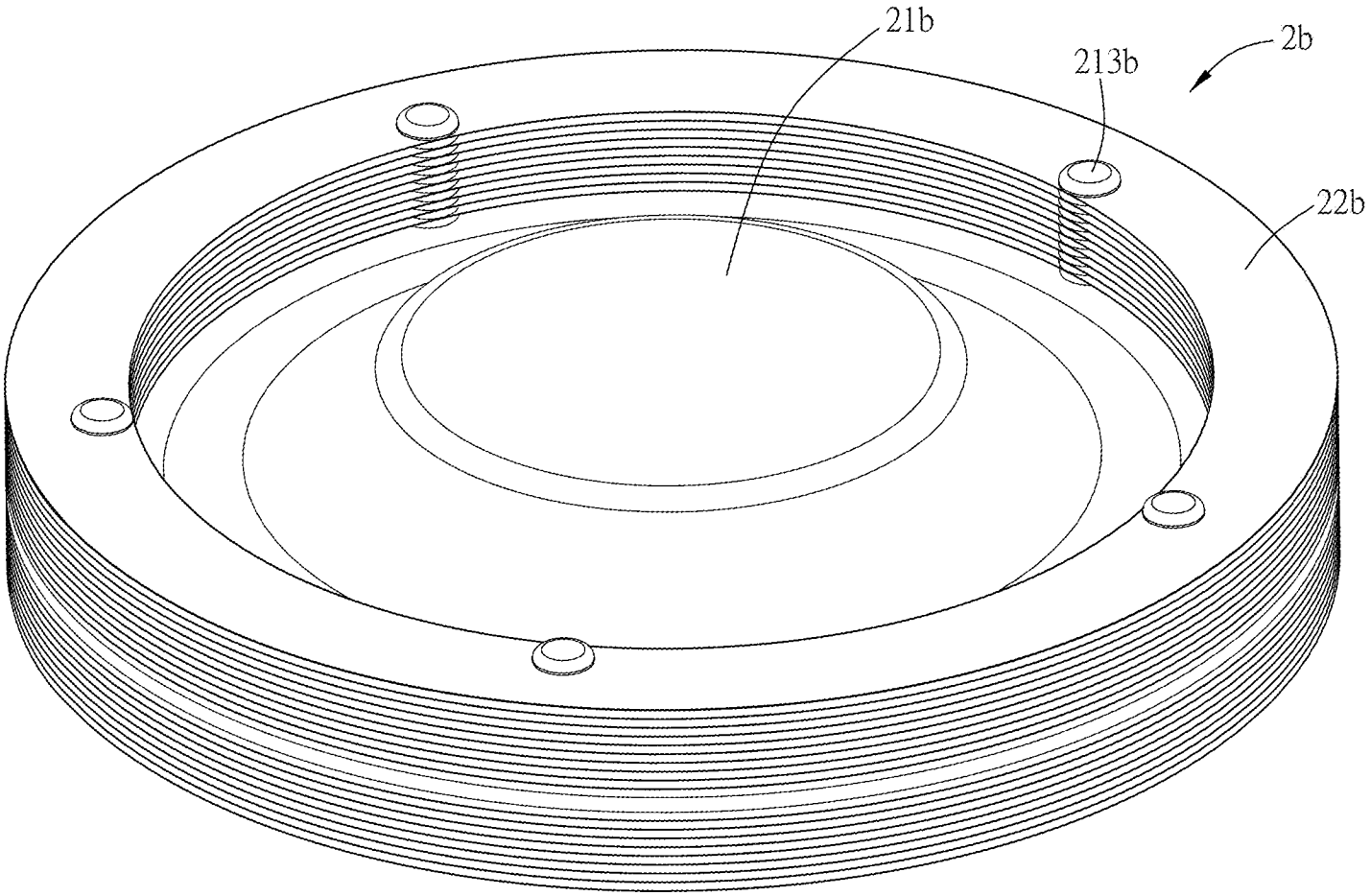
FIG. 3A is a schematic diagram showing the impeller of the fan according to a second embodiment of this disclosure.
Figure 3B:
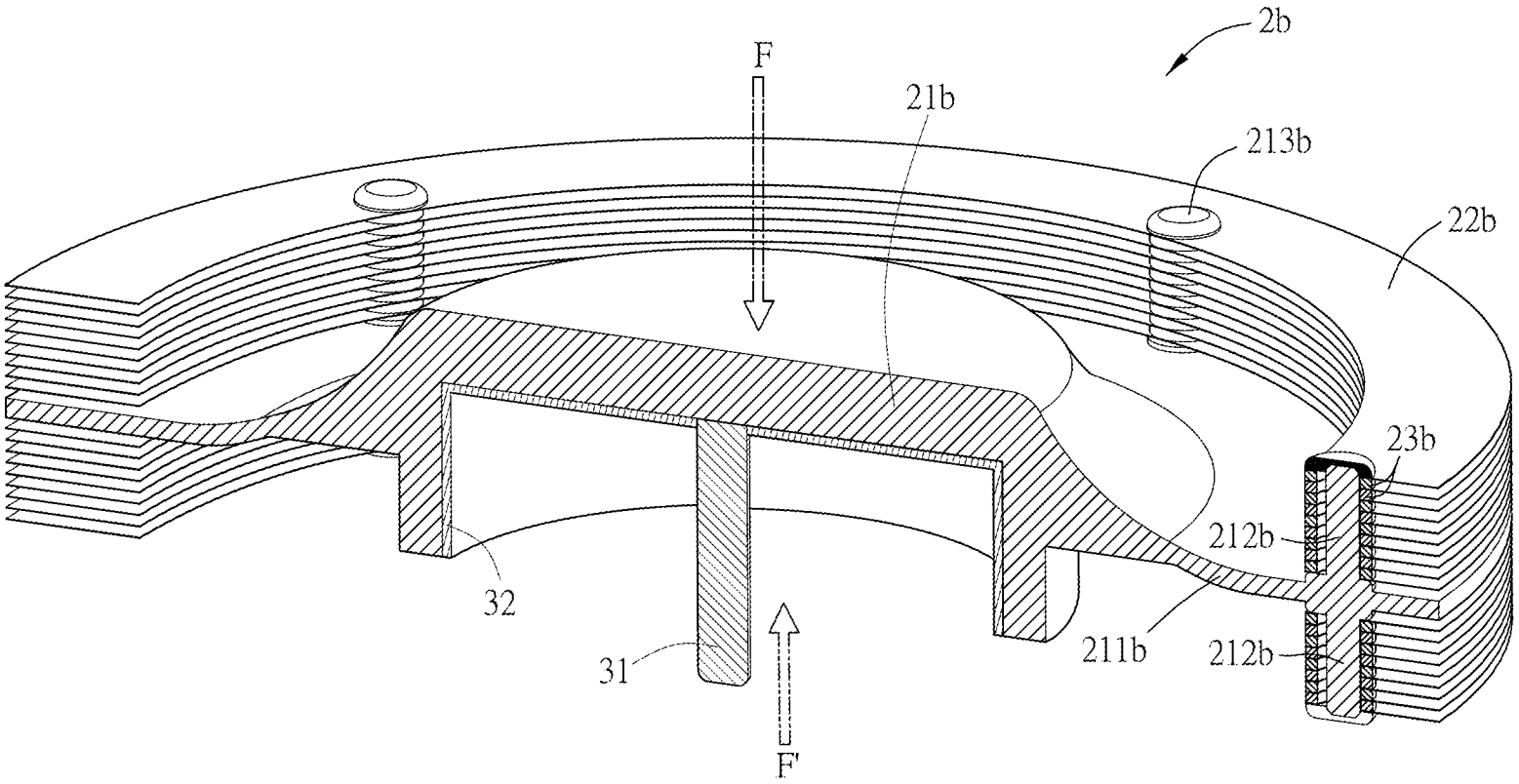
FIG. 3B is a sectional view of the impeller of FIG. 3A.

FIG. 3A is a schematic diagram showing the impeller of the fan according to a second embodiment of this disclosure, and FIG. 3B is a sectional view of the impeller of FIG. 3A. As shown in FIG. 3B, the fan impeller 2*b* comprises a hub 21*b*, a plurality of annular blades 22*b*, and a plurality of spacers 23*b*. The impeller 2*b* of FIG. 3B is mostly the same as the impeller 2*a* of FIG. 2B. Different from the impeller 2*a*, the annular blades 22*b* of the impeller 2*b* are disposed at two sides of the extension portion 211*b*, and the supporting columns 212*b* are disposed at two sides of the extension portion 211*b*. In other words, the impeller 2*b* includes two air input directions F and F', but the impeller 2*a* only includes one air input direction F.

Figure 4A:
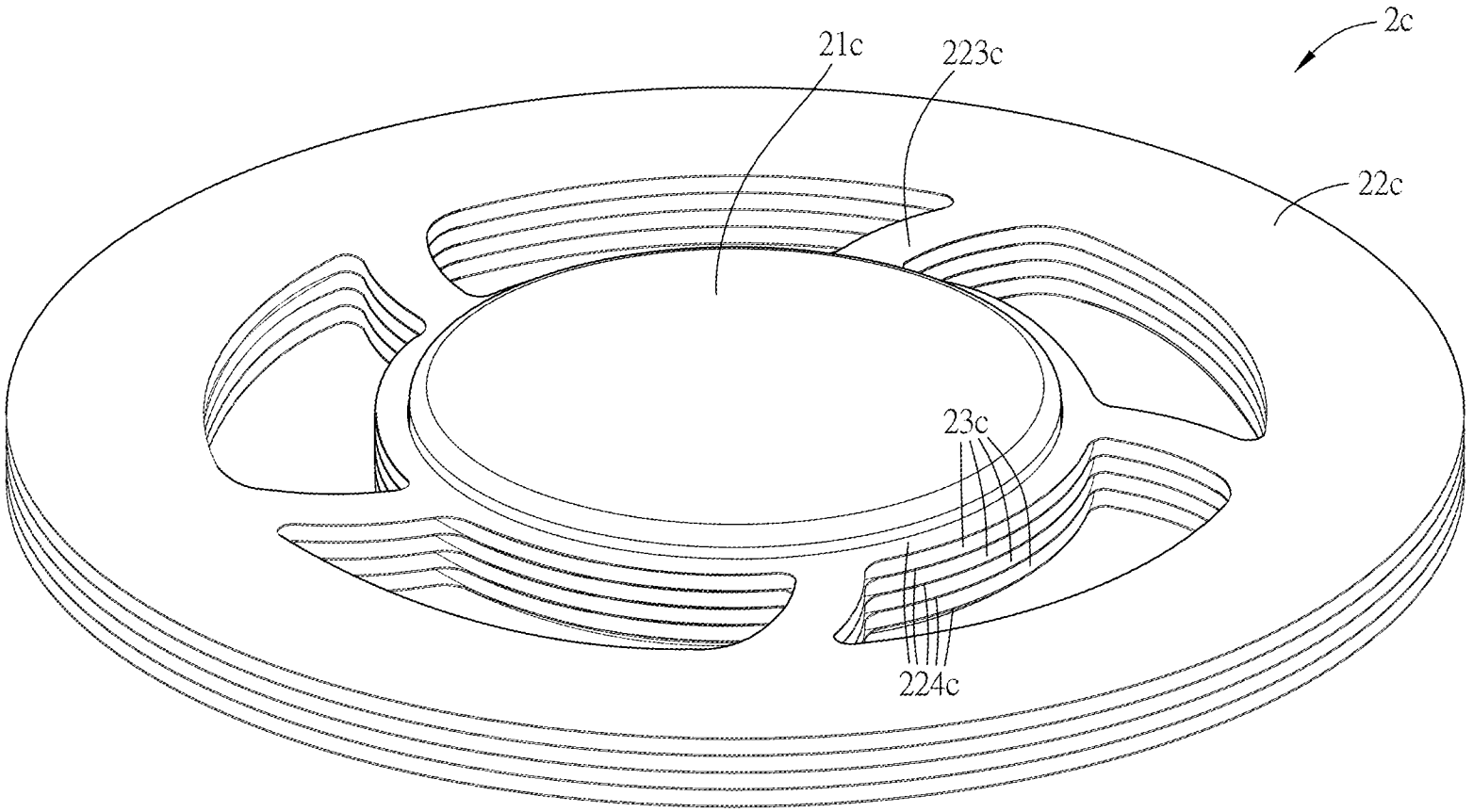
FIG. 4A is a schematic diagram showing the impeller of the fan according to a third embodiment of this disclosure.
Figure 4B:
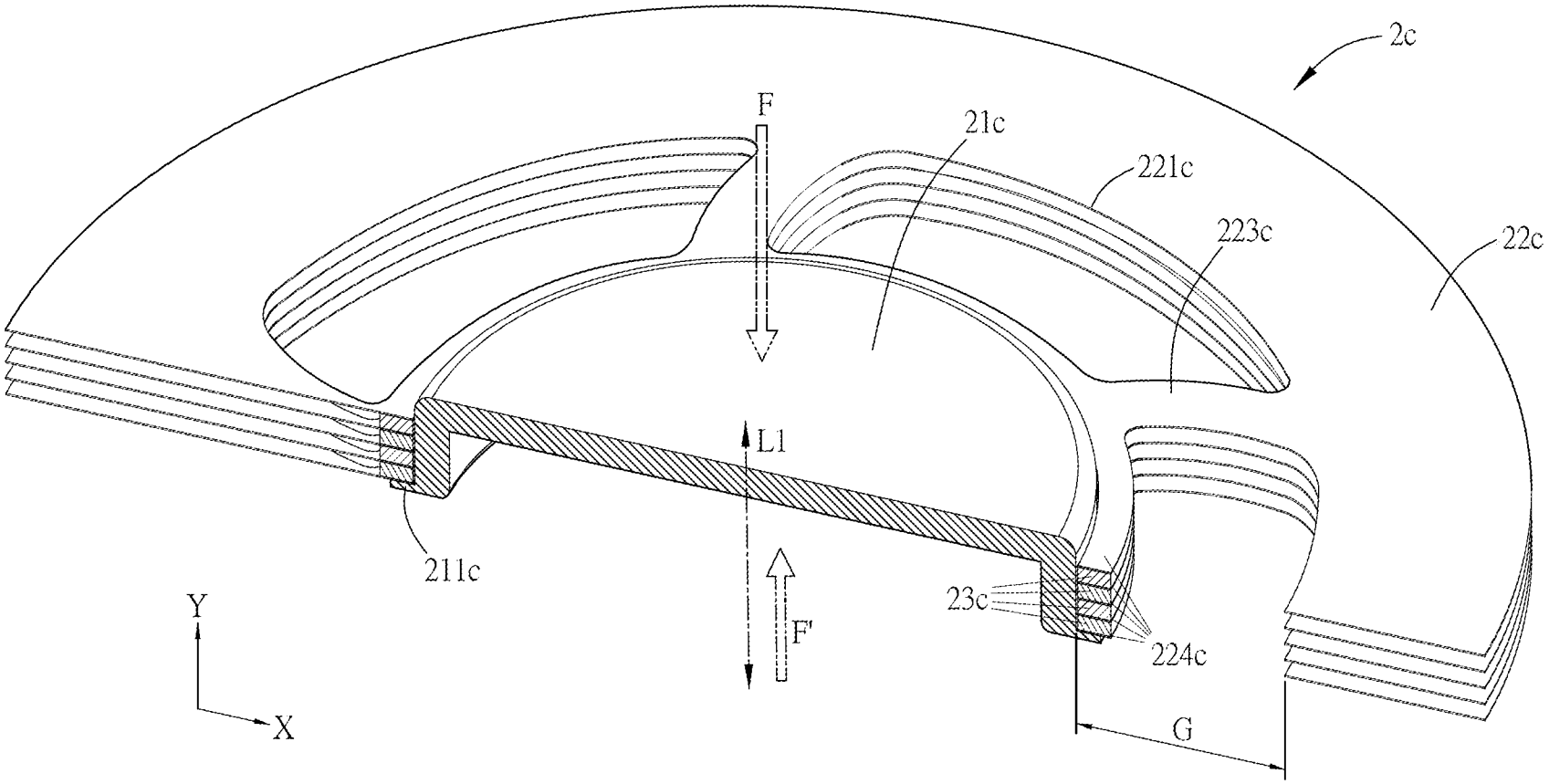
FIG. 4B is a sectional view of the impeller of FIG. 4A.

FIG. 4A is a schematic diagram showing the impeller of the fan according to a third embodiment of this disclosure, and FIG. 4B is a sectional view of the impeller of FIG. 4A. As shown in FIGS. 4A and 4B, the impeller 2*c* comprises a hub 21*c*, a plurality of annular blades 22*c*, and a plurality of spacers 23*c*. In this embodiment, the shaft 31 and the magnetic shell 32 are not shown. The annular blades 22*c* are stacked along an axial direction L1 of the hub 21*c* and disposed around an outer periphery of the hub 21*c*. The extension directions of the annular blades 22*c* are perpendicular to the axial direction L1 of the hub 21*c*. In more detailed, the axial direction L1 of the hub 21*c* is parallel to a Y-axis direction, and the extension directions of the annular blades 22*c* are parallel to an X-axis direction. The X-axis direction and the Y-axis direction are perpendicular to each other. Based on the configuration of the extension directions of the annular blades 22*c* and the axial direction L1 of the hub 21*c*, which are perpendicular to each other, the surface of the annular blades 22*c* can generate the shearing force caused by viscosity to induce the airflow, thereby decreasing the high-frequency noise generated by the fan.

In this embodiment, the annular blade 22*c* has an inner periphery 221*c*, and a gap G is provided between the inner periphery 221*c* and the hub 21*c*. Specifically, the gap G is configured for guiding the airflow, so that the airflow can pass through the gap G between the annular blades 22*c* and the hub 21*c*, the spaces between the annular blades 22*c*, and the air outlet of the fan.

In this embodiment, the annular blade 22*c* further comprises a plurality of spokes 223*c* and an inner ring 224*c*. The inner ring 224*c* is disposed on and connected to the outer periphery of the hub 21*c*, and two ends of the spoke 223*c* are connected to the inner periphery 221*c* and the inner ring 224*c* of the annular blade 22*c*. To be noted, although the figure shows five spokes 223*c* disposed between the inner periphery 221*c* and the inner ring 224*c* of the annular blade 22*c* with equivalent intervals, the number of the configured spokes 223*c* can be adjusted. In addition, the spokes 223*c* can be separately disposed with inequivalent intervals (not shown). This disclosure is not limited.

In this embodiment, each of the spacers 23*c* is disposed between the two adjacent inner rings 224*c* for separating the two adjacent annular blades 22*c*. The thickness of the annular blades 22*c*, the ratio of the thickness of the spacers 23*c* to that of the annular blades 22*c*, and the ratio of the inner radius to the outer radius of the annular blades 22*c* can be referred to the above-mentioned impeller 2*a*, so the detailed descriptions thereof will be omitted.

Figure 4C:
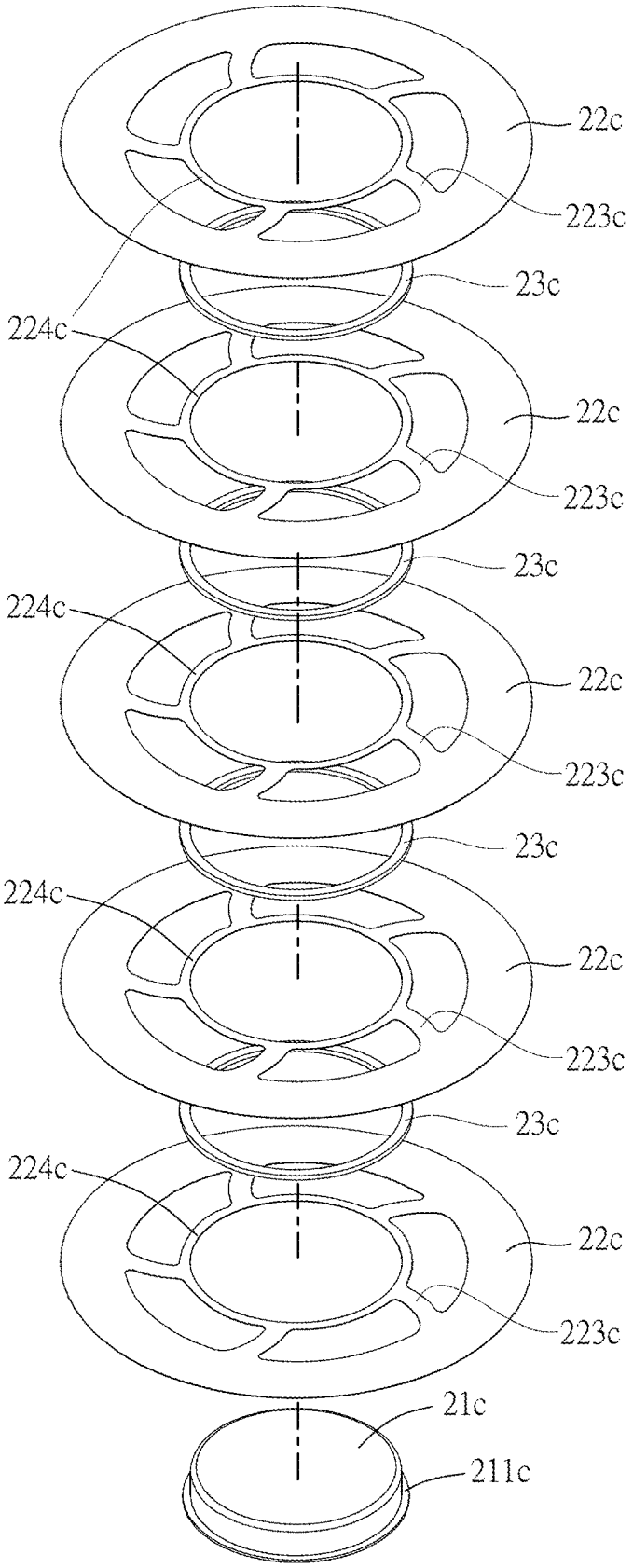
FIG. 4C is an exploded view of the impeller of FIG. 4A.

FIG. 4C is an exploded view of the impeller of FIG. 4A. In this embodiment, as shown in FIGS. 4B and 4C, a bottom portion of the hub 21*c* has a protrusion portion 211*c* extending outwardly and perpendicular to the axial direction L1, and the annular blades 22*c* are disposed on the protrusion portion 211*c* of the hub 21*c* by stacking the inner rings 224*c* on the protrusion portion 211*c*. The inner ring 224*c* of one annular blade 22*c* passes through the hub 21*c* and disposed on the protrusion portion 211*c*, and then the space 23*c* also passes through the hub 21*c*. Afterwards, another annular blade 22*c* is stacked on the previous annular blade 22*c*. After disposing the annular blades 22*c* and spacers 23*c* alternately, the annular blades 22*c* can be stacked and disposed on the protrusion portion 211*c*. To be noted, although the figure shows that the impeller 2*c* comprises five annular blades 22*c* and four spacers 23*c*, the numbers of the configured annular blades 22*c* and spacers 23*c* can be adjusted based on the requirement of the user. This disclosure is not limited.

Figure 4D:
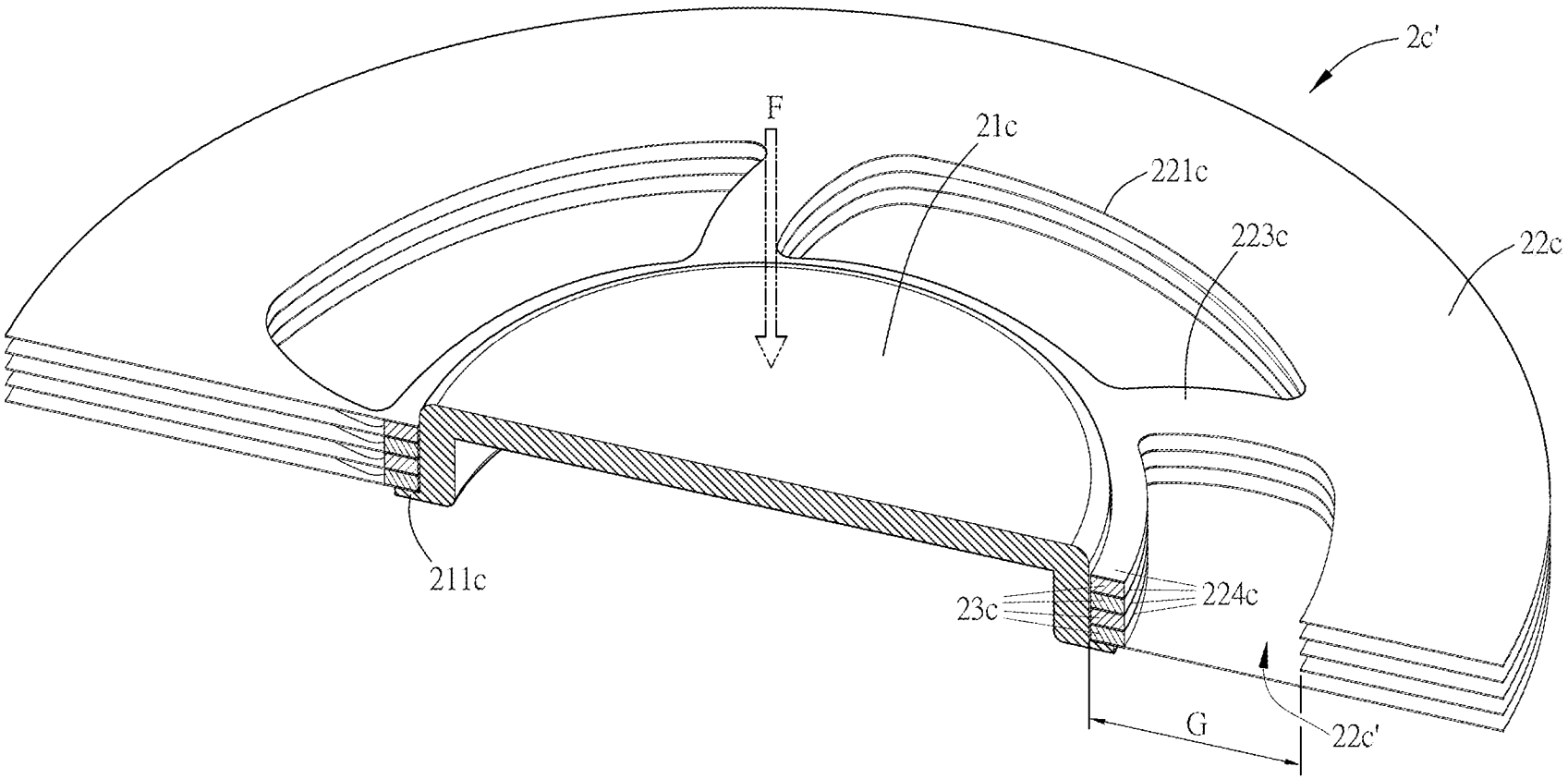
FIG. 4D is a sectional view of a modified impeller of the fan according to the third embodiment of this disclosure.

FIG. 4D is a sectional view of a modified impeller of the fan according to the third embodiment of this disclosure. The structure of the impeller 2*c*' as shown in FIG. 4D is similar to the structure of the impeller 2*c* as shown in FIG. 4B. Different from the impeller 2*c* of FIG. 4B, the impeller 2*c*' shown in FIG. 4D does not comprise the gap G between the hub 21*c* and the annular blade 22*c*', which is located closest to the protrusion portion 211*c*. In other words, the annular blade 22*c*' located closest to the protrusion portion 211*c* does not have the spoke 223*c*. Accordingly, the impeller 2*c*' has only one air input direction F.

In the above embodiments, the annular blades 22*a*, 22*c*, 22*c*, and 22*c*' are made of metal, such as, for example but not limited to, stainless steel, aluminum alloy, or titanium alloy. The hubs 21*a*, 21*b*, and 21*c* are made of plastic or metal.

In summary, the impeller of the fan of this disclosure comprises a plurality of annular blades stacked along an axial direction of the hub and disposed around an outer periphery of the hub, and the extension directions of the annular blades are perpendicular to the axial direction of the hub. According to this design, the fan of this disclosure can induce the airflow by the shearing force, thereby decreasing the high-frequency noise. In addition, since the annular blades of this disclosure have a thinner thickness, it is possible to configure more annular blades, thereby increasing the performance of inducing airflow by the fan.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

a frame;

an impeller disposed in the frame and comprising:

a hub, a plurality of annular blades stacked along an axial direction of the hub and disposed around an outer periphery of the hub, wherein extension directions of the annular blades are perpendicular to the axial direction of the hub, and a plurality of spacers, each of the spacers is disposed between the two adjacent annular blades; and a motor disposed in the frame and driving the impeller to rotate to induce an airflow;

wherein a thickness of each of the annular blades is smaller than or equals to 0.2 mm;

wherein each of the annular blades has an inner periphery, and a gap is provided between the inner periphery and the hub;

wherein a bottom portion of the hub has an extension portion extending outwardly and perpendicular to the axial direction, and the annular blades are stacked and disposed at one side of the extension portion, or the annular blades are stacked and disposed at two sides of the extension portion; and wherein the hub further comprises a plurality of supporting columns, the supporting columns are disposed at the extension portion, each of the annular blades comprises a plurality of through holes, and the supporting columns pass through the through holes, respectively.

2. The fan according to claim 1, wherein the spacers are disposed around the supporting columns, respectively.

3. The fan according to claim 1, wherein the supporting columns are separately disposed on the extension portion with equivalent intervals.

4. The fan according to claim 1, wherein the supporting columns are separately disposed on the extension portion with inequivalent intervals.

5. The fan according to claim 1, wherein each of the annular blades further comprises a plurality of spokes and an inner ring, the inner ring is disposed on and connected to the outer periphery of the hub, and two ends of the spoke are connected to the inner periphery and the inner ring of the annular blade, respectively.

6. The fan according to claim 5, wherein the spacers are separately disposed on the inner rings of the annular blades, respectively.

7. The fan according to claim 5, wherein a bottom portion of the hub has a protrusion portion extending outwardly and perpendicular to the axial direction, and the annular blades are disposed on the protrusion portion of the hub by stacking the inner rings on the protrusion portion.

8. The fan according to claim 1, wherein a ratio of a thickness of each of the spacers to a thickness of each of the annular blades is greater than or equal to 1.

9. The fan according to claim 1, wherein a ratio of an inner radius of the annular blades to an outer radius of the annular blades is greater than or equal to 0.5.

10. The fan according to claim 1, wherein the frame forms a guiding surface at an inner periphery of an air inlet of the fan.

11. A fan impeller, comprising:

a hub;

a plurality of annular blades stacked along an axial direction of the hub and disposed around an outer periphery of the hub, wherein extension directions of the annular blades are perpendicular to the axial direction of the hub; and a plurality of spacers, each of the spacers is disposed between the two adjacent annular blades;

wherein each of the annular blades has an inner periphery, and a gap is provided between the inner periphery and the hub;

wherein a bottom portion of the hub has an extension portion extending outwardly and perpendicular to the axial direction;

wherein the annular blades are stacked and disposed at one side of the extension portion, or the annular blades are stacked and disposed at two sides of the extension portion; and wherein the hub further comprises a plurality of supporting columns disposed at the extension portion, each of the annular blades comprises a plurality of through holes, and the supporting columns pass through the through holes, respectively.

12. The fan impeller according to claim 11, wherein each of the annular blades further comprises a plurality of spokes and an inner ring, the inner ring is disposed on and connected to the outer periphery of the hub, and two ends of the spoke are connected to the inner periphery and the inner ring of the annular blade.

13. The fan impeller according to claim 12, wherein the spacers are separately disposed on the inner rings of the annular blades, respectively.

14. A fan, comprising:

a frame;

an impeller disposed in the frame and comprising:

a hub, a plurality of annular blades stacked along an axial direction of the hub and disposed around an outer periphery of the hub, wherein extension directions of the annular blades are perpendicular to the axial direction of the hub, and a plurality of spacers, each of the spacers is disposed between the two adjacent annular blades; and a motor disposed in the frame and driving the impeller to rotate to induce an airflow;

wherein a thickness of each of the annular blades is smaller than or equals to 0.2 mm;

wherein each of the annular blades has an inner periphery, and a gap is provided between the inner periphery and the hub;

wherein each of the annular blades further comprises a plurality of spokes and an inner ring, the inner ring is disposed on and connected to the outer periphery of the hub, and two ends of the spoke are connected to the inner periphery and the inner ring of the annular blade, respectively; and wherein a bottom portion of the hub has a protrusion portion extending outwardly and perpendicular to the axial direction, and the annular blades are disposed on the protrusion portion of the hub by stacking the inner rings on the protrusion portion.

15. The fan according to claim 14, wherein a bottom portion of the hub has an extension portion extending outwardly and perpendicular to the axial direction, and the annular blades are stacked and disposed at one side of the extension portion, or the annular blades are stacked and disposed at two sides of the extension portion.

16. The fan according to claim 14, wherein the spacers are separately disposed on the inner rings of the annular blades, respectively.

17. The fan according to claim 14, wherein a ratio of a thickness of each of the spacers to a thickness of each of the annular blades is greater than or equal to 1.

18. The fan according to claim 14, wherein a ratio of an inner radius of the annular blades to an outer radius of the annular blades is greater than or equal to 0.5.

19. The fan according to claim 14, wherein the frame forms a guiding surface at an inner periphery of an air inlet of the fan.

* * * * *